United States Patent [19]

Mariol et al.

[11] Patent Number: 4,818,016

[45] Date of Patent: Apr. 4, 1989

[54] HOOK-ON TYPE BABY CHAIR

[75] Inventors: John V. Mariol; David W. Rice, both of Cincinnati, Ohio

[73] Assignee: James F. Mariol, Cincinnati, Ohio

[21] Appl. No.: 101,679

[22] Filed: Oct. 1, 1987

[51] Int. Cl.[4] ..... A47B 83/02

[52] U.S. Cl. ..... 297/174; 297/153; 297/DIG. 2; 297/423

[58] Field of Search ..... 297/174, 134, 487, 148, 297/155, 425

[56] References Cited

U.S. PATENT DOCUMENTS

| | | | |
|---|---|---|---|
| 2,451,667 | 10/1948 | Duley | 297/174 |
| 3,133,760 | 5/1964 | Robinson | 297/174 |
| 4,312,535 | 1/1982 | Smith | 297/174 |
| 4,362,333 | 12/1982 | Cohen | 297/174 |
| 4,506,928 | 3/1985 | Marion | 297/174 |
| 4,568,120 | 2/1986 | Hoffman | 297/174 |
| 4,650,246 | 3/1987 | Henriksson | 297/487 |

*Primary Examiner*—Francis K. Zugel

*Attorney, Agent, or Firm*—Charles R. Wilson

[57] ABSTRACT

A hook-on type baby chair intended for use with a tabletop is comprised of a chair, frame assembly and latch means. The frame assembly itself is comprised of (1) a pair of anchor members secured to the baby chair and dimensioned to overlie the tabletop, (2) a pair of vertical arm members extending from the anchor members to a seat portion of the chair and (3) a pair of grip members with gripper feet on one extremity to contact the underside of the tabletop and pivotably attached to the vertical arm members for movement. A latch means is associated with the anchor members and grip members to secure the baby chair to any thickness tabletop, yet allow ready disengagement therefrom.

23 Claims, 5 Drawing Sheets

HOOK-ON TYPE BABY CHAIR

This invention relates to a baby chair. More particularly, the invention relates to a baby chair intended to be used with a tabletop.

BACKGROUND OF THE INVENTION

Hook-on type baby chairs have been in existance for a number of years. Examples of such baby chairs can be found in U.S. Pat. Nos. 4,312,535, 4,506,928 and 4,568,120. The known chairs have a pair of members which are intended to overlie the tabletop. A second pair of members are intended to engage the tabletop's underside. A force is applied to cause the members to move toward one another so as to clamp the unit to the tabletop. Necessarily, any such mechanism used to effect a clamping action must be easy to use and reliable.

The baby chairs of the prior art all suffer in one way or another. Some of the chairs can accomodate one tabletop thickness, but are less secure with other tabletop thicknesses. Some of the chairs have latching mechanisms which are cumbersome to use and/or are not aesthetically pleasing. Certain of the known chairs are also cumbersome to position on the tabletop and thereafter remove because of their frame construction.

In accordance with a demonstrated need, a hook-on type baby chair has been developed which readily attaches to a tabletop. The baby chair is capable of engaging different thicknesses of tabletops without a loss of gripping power.

SUMMARY OF THE INVENTION

A hook-on type baby chair for use with a tabletop comprises a chair having a seat portion and a back portion with a frame assembly associated therewith. The frame assembly comprises a pair of anchor members each secured to the baby chair and dimensioned so that their extremities overlie the tabletop. A pair of vertical arm members extend from the anchor members to the seat portion. A pair of grip members are pivotably attached to the vertical arm members. Gripper feet on the grip member extremities are intended to engage the underside of the tabletop. Latch means are associated with the anchor members and the grip members so as to allow the baby chair to readily engage the tabletop and be disengaged therefrom. A plurality of latch positions are possible with the latch means.

DETAILED DESCRIPTION OF THE INVENTION

Figure 1:
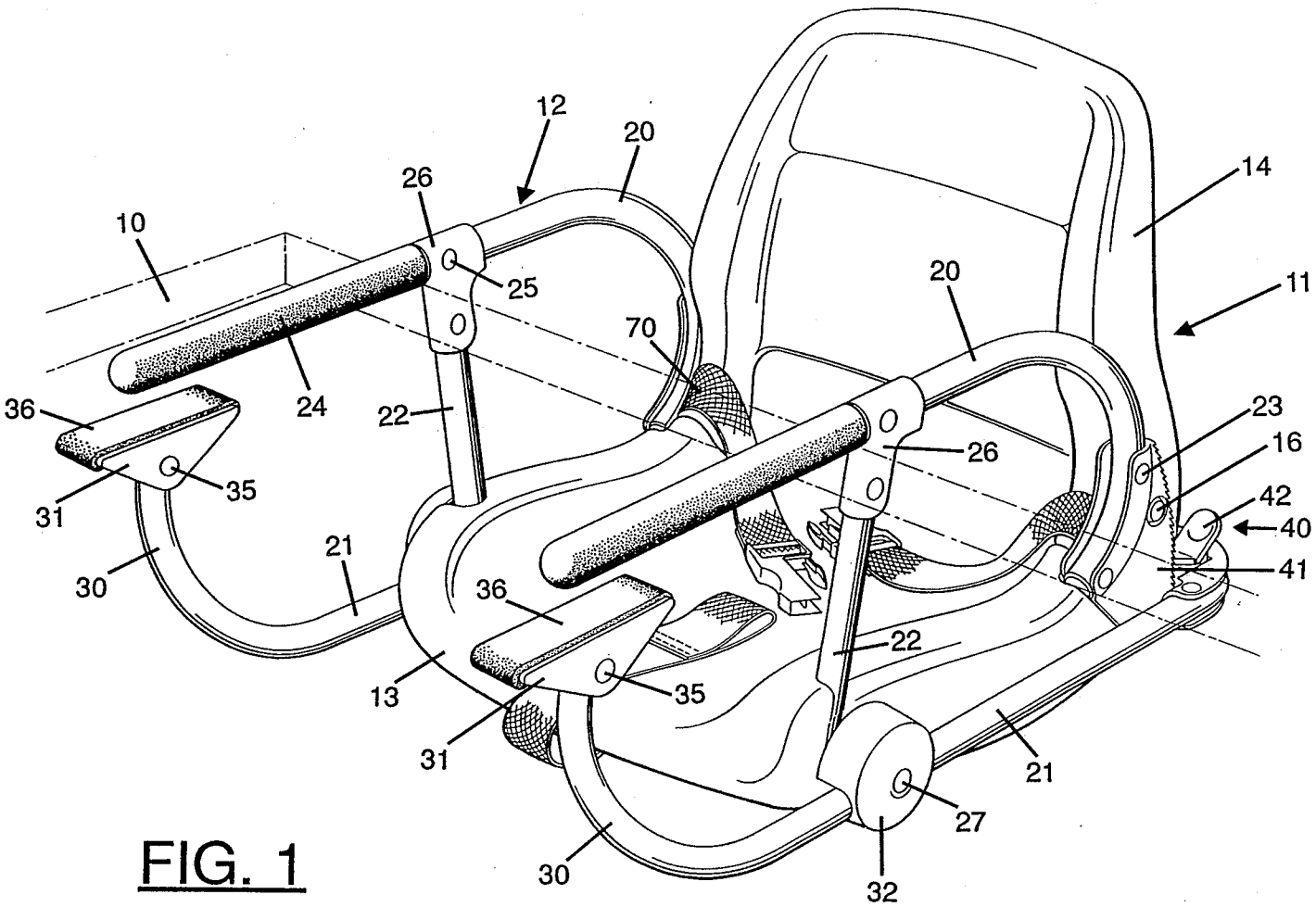
FIG. 1 is a view in perspective of the hook-on type baby chair of this invention positioned on a table.

Referring to FIG. 1, the baby chair of this invention is shown secured to an edge of a tabletop 10 indicated in dotted lines. The tabletop can be part of a kitchen table, picnic table, countertop or the like. The baby chair includes a chair shown generally as 11 and a frame assembly shown generally as 12.

The hook-on type baby chair of this invention includes a seat portion 13 and a back portion 14. As illustrated in FIGS. 1–4 and best shown in FIG. 4, the two portions are separate pieces dimensioned to mate at their point of contact. A connecting rod 15 extends through a lower part of the back portion on one side, the seat portion and the lower part of the back portion on another side to hold said seat portion and back portion in place. As discussed more fully in following paragraphs, the areas at which the seat portion and back portion mate are contoured to allow the back portion to fold towards the seat portion for storage convenience. Alternatively, the chair can be one integral piece, preferably molded of plastic with contoured areas in the seat portion and back portion for comfort purposes.

Three sets of frame members are provided for operable association with the chair to achieve the desired hook-on capability to a tabletop. Anchor members 20, grip members 21, and vertical arm members 22 are all interconnected to provide a frame assembly. Preferably, the members are made of non-corrosive hollow metal tubes which are chrome plated or otherwise protected.

Anchor members 20 are each secured to the baby chair. As evident in FIGS. 1 and 2, the anchor members 20 are each fixedly attached by rivots 23 to ratchet boxes 41 which in turn are held to the back portion by connecting rod 15 and hub nut 16. Such ratchet boxes are a part of the latch means found on the baby chair and are discussed in detail in following paragraphs. The anchor members are dimensioned to overlie a tabletop and partially provide the means by which the baby chair is securely held by the tabletop. The extremity of each anchor member is preferably covered with a sleeve 24 to provide gripping and prevent marring of the tabletop.

Vertical arm members 22 are each fixed to an anchor member 20 by attachment means 26. The vertical arm members 22 extend to the seat portion 13 and are fixedly secured thereto by conventional attachment means, e.g. rivots 27. Preferably, for ease of manufacture and maximum stability, the vertical arm members are the arms of a continuous U-shaped member 28. The U-shaped member 28 extends across the underside of the seat portion. The seat portion is molded in a fashion to provide a channel 29 in its underside and side walls to accomodate the U-shaped member.

Pivotably attached to each vertical arm member at a lower extremity are two grip members 21. The grip members have a curved extremity 30 with gripper feet 31 positioned at the ends to frictionally contact the undersurface of the tabletop. The grip members are pivotably attached to the vertical arms to allow movement of the gripper feet towards and away from the anchor member extremitites which overlie the tabletop. Rivot 27 acting as a pivot pin extends through a cover hub 32 into the vertical arm member 22. A washer 33 is positioned between the grip member and vertical arm member. Each grip member extends to the backside of the baby chair. Preferably, one U-shaped member 34 extends across the backside of the baby chair with each arm of the U-shaped member representing a grip member.

Gripper feet 31 are pivotably attached by pivot pin 35 to the grip members' extremities to allow a certain degree of adjustment with different thickness tabletops. A gripping pad 36 on the upper surface of each foot aids in maintaining contact with the tabletop underside during use of the baby chair.

Latch means 40 are associated with the anchor members and grip members to allow the baby chair to be readily engaged to the tabletop or disengaged therefrom. The pivot movement of the grip members and ability of the latch means to lock in more than one position results in the baby chair being useable with tabletops having a wide range of thicknesses and edge configurations.

The latch means 40 associated with each anchor member and grip member comprises a ratchet box 41 and a pawl 42 positioned on each side of the chair. The ratchet box 41 has a housing shaped to fit the contours of the baby chair and a channel 43 to receive the anchor arms. As previously mentioned, the ratchet box on each side of the chair is fixedly secured to the chair by the connecting rod 15 and hub nut 16. In effect, the ratchet box secures the anchor members to the chair. A back side of the ratchet box 41 has a series of teeth 44 extending vertically. A pawl 42 positioned on the grip members is in operable association with the ratchet box teeth. Housing body 45 at least partially encompasses the grip member and is secured thereto. Pawl 42 is pivotably connected to the housing body 45 by pivot boss 46. Pressure exerted on a thumb portion 47 of the pawl causes end portion 48 to be disengaged from the ratchet box teeth 44. A spring mechanism 49 is associated with the pawl to cause the pawl to return to a rest position when pressure is removed from the thumb portion and in effect, locks the pawl into the teeth.

Figure 2:
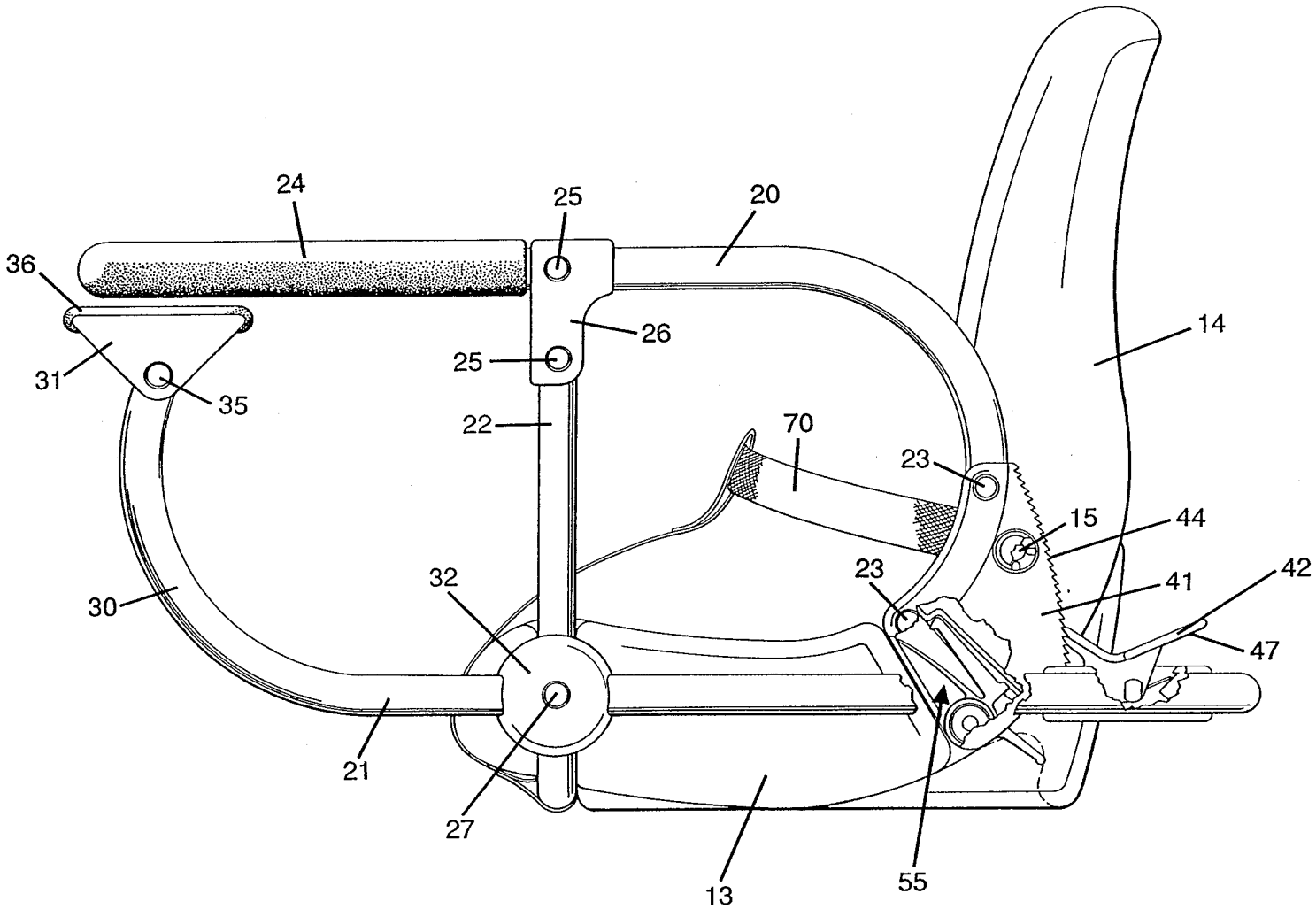
FIG. 2 is a side view of a baby chair of FIG. 1 with portions cut-away to show a latch means and a locking mechanism.
Figure 3:
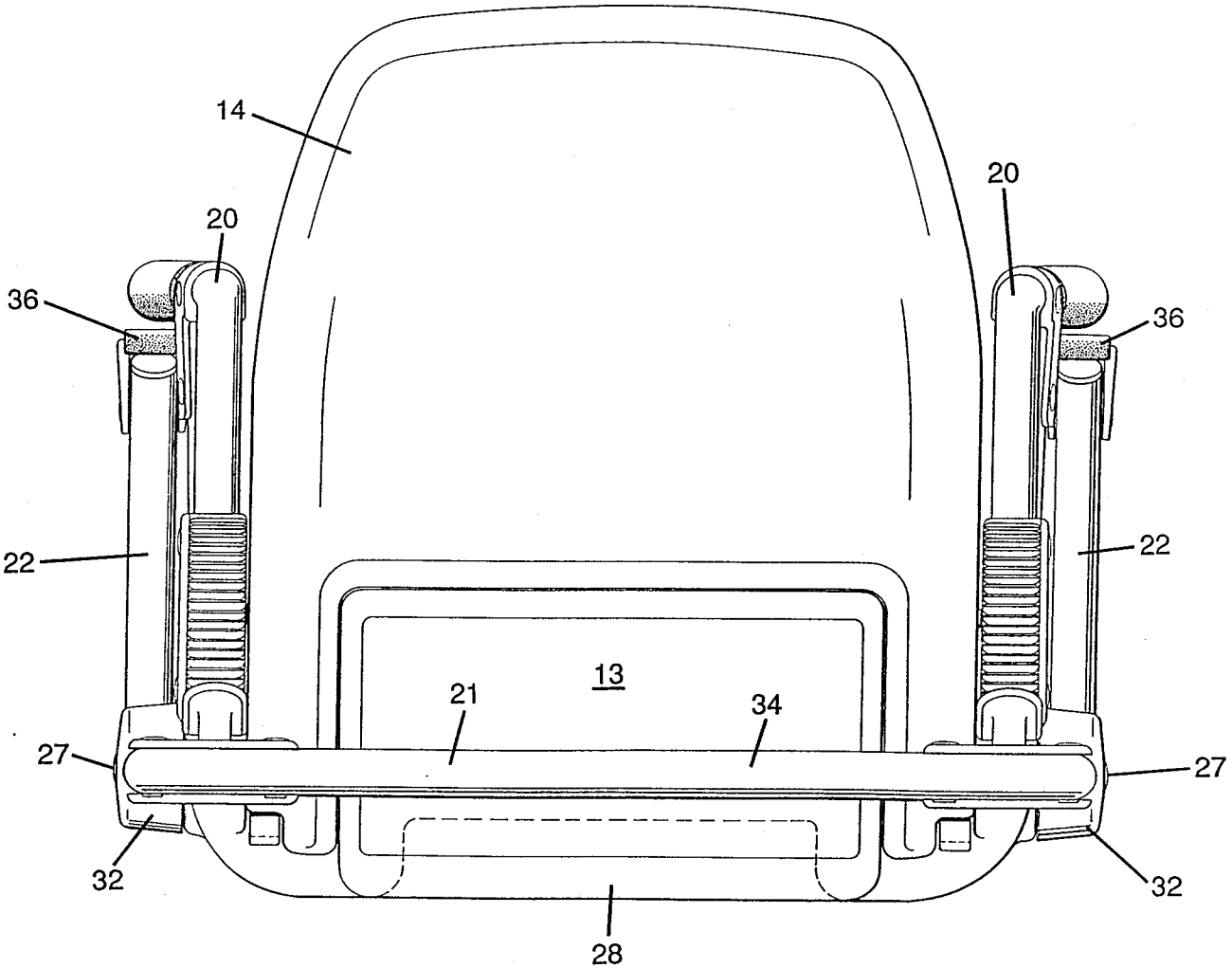
FIG. 3 is a back view of the baby chair of FIG. 1.

For ease of operation, the seat portion 13 has a recess in its underneath surface, shown in phantom in FIGS. 2 and 3. This recess provides a gripping surface for when the latch means is operated. Additionally, the recess serves as a handle for transporting the baby chair.

Figure 4:
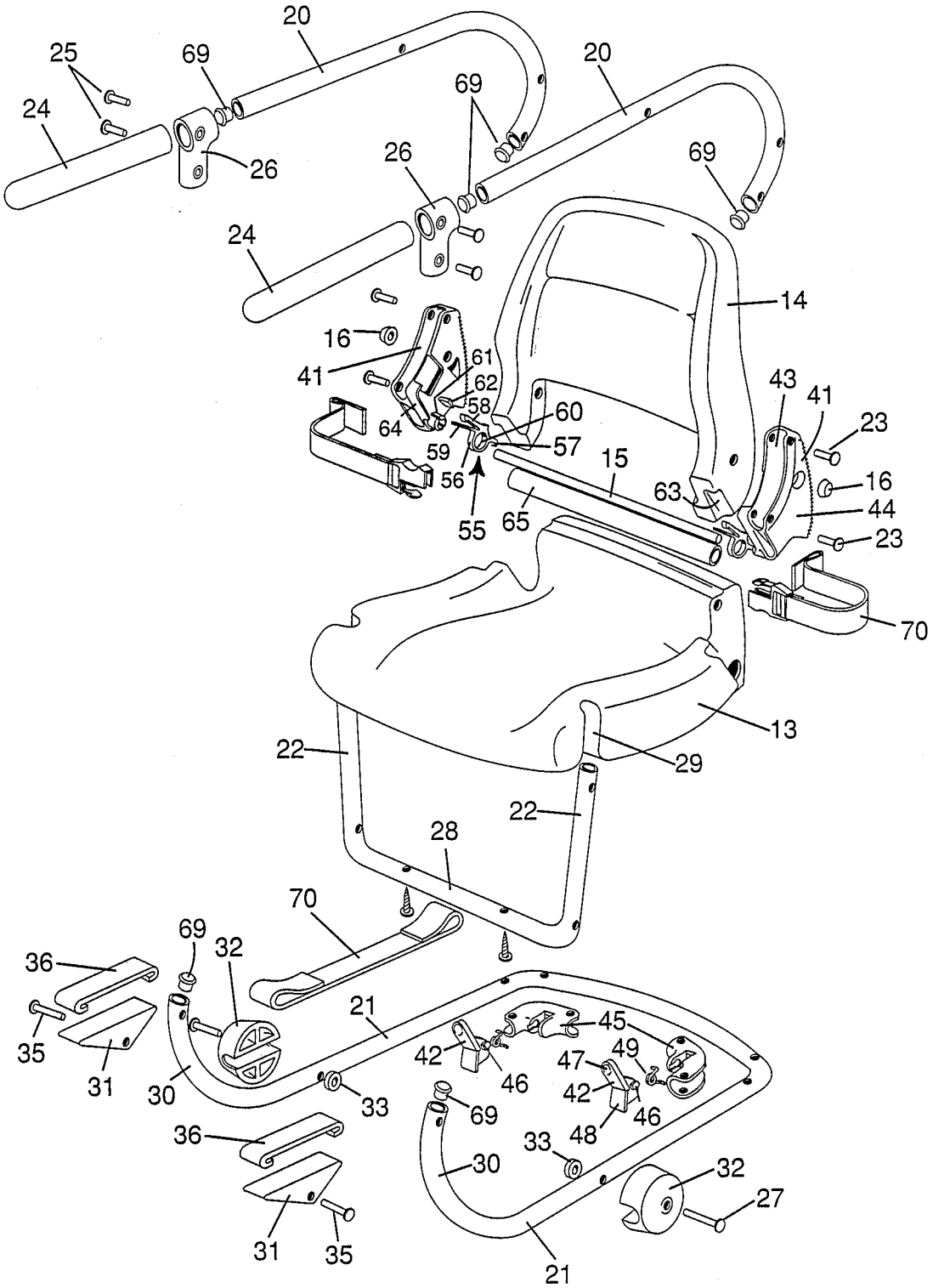
FIG. 4 is an exploded view of the baby chair of FIG. 1.

A feature best depicted in FIGS. 2 and 4 is a locking mechanism 55 associated with the ratchet box housing 41. This feature adds a measure of stability to those baby chairs of the invention wherein the seat portion and back portion are two separate pieces. The lock mechanism comprises a main body 56 with a finger lever 57, lock prong 58 and flexible guide prong 59. The main body has a hole 60 dimensioned to movably fit over a protrusion 61 found on the ratchet box. A stop 62 on the ratchet box in conjunction with contact of the lock prong 58 with a recessed shoulder 63 in the back portion keeps the back portion in a stable position. The flexible guide prong 59 is dimensioned to contact a fender 64 found on the ratchet box to hold the lock prong 58 in a locking position. The mechanism is unlocked by applying a force to the finger lever 57 which causes lock prong 58 to disengage its locking position. The flexible nature of the guide prong 59 forces the lock prong back into a locking position when the force is removed from the finger lever.

As most evident from FIG. 4, an optional reinforcing tube 65 is provided in the seat portion. The tube is dimensioned to fit over protrusions 61 found on each ratchet box. The hole 60 in locking mechanisms 55 are then dimensioned to fit over the reinforcing tube.

Figure 5:
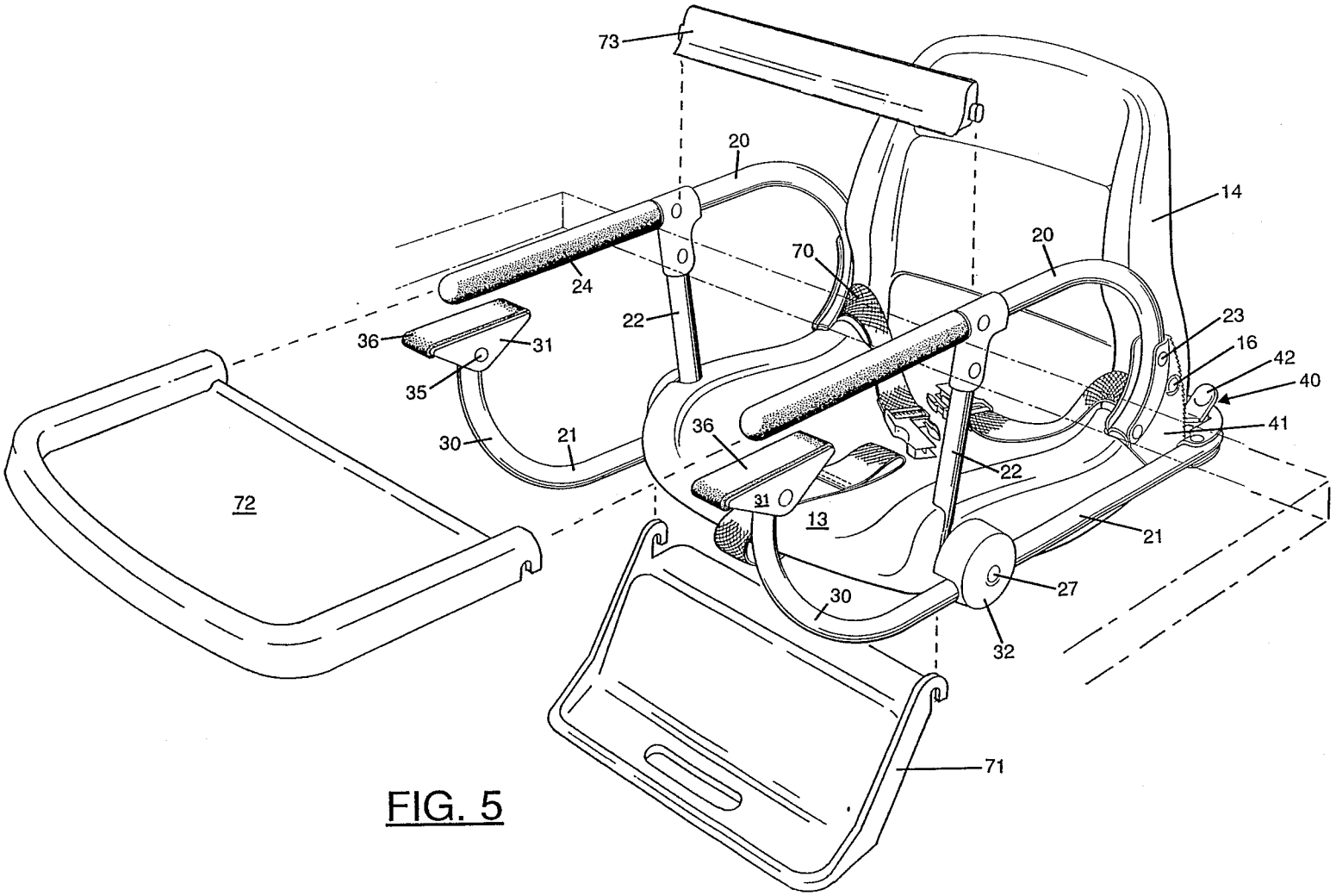
FIG. 5 is a view in perspective of an alternative hook-on type baby chair.

Optional features found on the baby chair of FIGS. 1–4 are end caps 69 for appearance and safety purposes and a safety belt 70 to hold the child in the chair. Still additional optional features are depicted in FIG. 5. These include pivotably attached foot rest 71, tray 72, and spill guard 73 made of a flexible material to abut the tabletop to prevent spills and tableware slide. Conventional means of attachment are used to secure the optional features to the baby chair's frame assembly.

In operation, the baby chair is first secured to a tabletop by releasing the latch means. Downward pressure applied to the thumb portion of the pawl disengages the pawl's end portion from the ratchet box teeth. This allows the grip members to pivot freely about their pivot points which in turn causes the gripper feet at the grip member extremities to swing away from the anchor member extremities. While in the open position, the chair is positioned on the tabletop so that the anchor members overlie the tabletop and the chair is pushed towards the table until the vertical arm members' attachment means contact with the table top to prevent further movement. A force is next applied to the grip members until the gripper feet make contact with the underside of the tabletop. The downward cut of the teeth allows the pawls to ride along the series of teeth until the grip members are properly positioned. Removal of the chair from the table is readily accomplished by disengaging the latch means and pulling the chair away. The chair depicted in FIGS. 1–4 can be conveniently stored by folding the back portion towards the seat portion to reduce the chair's overall size.

Various modifications of the descried hook-on type baby chair can be made without departing from the spirit of the invention. All obvious variations are considered within the scope of the appended claims.

What is claimed is:

1. A hook-on type baby chair for use with a tabletop, comprising:

(a) a chair having a seat portion and a back portion;

(b) a pair of anchor members each secured to the baby chair and dimensioned so that the anchor member extremities overlie the tabletop to position the baby chair for use;

(c) a pair of vertical arm members extending from the anchor members to the seat portion, wherein said vertical arm members are each fixedly attached to said anchor members and fixedly attached to said seat portion;

(d) a pair of grip members each having a gripper foot on one extremity to frictionally contact an undersurface of the tabletop and each of said members pivotably attached to the vertical arm members for movement of the gripper feet towards and away from the anchor member extremities which overlie the tabletop; and (e) latch means associated with the anchor members and the grip members so that when disengaged the grip members are free to pivotably move about their points of attachment and when engaged the gripper foot of each grip member is in fixed contact with the undersurface of the tabletop to securely hold the baby chair to the tabletop, further wherein the latch means are capable of providing a plurality of latch positions to accommodate different thickness tabletops and facilitate removable of the baby chair therefrom.

2. The hook-on type baby chair of claim 1 wherein the grip members comprise one U-shaped member which extends across the backside of the baby chair with each arm of the U-shaped member representing a grip member.

3. The hook-on type baby chair of claim 1 wherein the vertical arm members comprise one U-shaped member which extends across the underside of the seat bottom with each arm of the U-shaped member representing a vertical arm member.

4. The hook-on type baby chair of claim 1 wherein the latch means comprises at least one ratchet box secured to the anchor member and a pawl secured to the grip member wherein the pawl has a lever such that the lever will engage teeth found on the ratchet box and be held in place, yet when said lever is disengaged from the teeth the grip members freely move about their pivot points.

5. The hook-on type baby chair of claim 4 wherein the seat portion and back portion are one integral piece.

6. The hook-on type baby chair of claim 4 wherein the seat portion and the back portion are two separate pieces dimensioned to mate at their point of contact.

7. The hook-on type baby chair of claim 6 wherein the back portion is pivotably attached to the ratchet box to allow the back portion to fold towards the seat portion about the pivot point.

8. The hook-on type baby chair of claim 7 wherein the gripper members are pivotably attached to the vertical arm members at the points where the vertical arm members are attached to the seat portion.

9. The hook-on type baby chair of claim 8 further having a safety belt for securing a child in the baby chair during use.

10. The hook-on type baby chair of claim 1 wherein all the members are tubular-shaped.

11. The hook-on type baby chair of claim 4 wherein the latch means comprises two ratchet boxes and wherein the anchor members are indirectly attached to the baby chair by their attachment to the ratchet boxes.

12. The hook-on type baby chair of claim 1 further comprising a tray attached to the anchor arms.

13. The hook-on type baby chair of claim 1 further comprising a foot rest pivotably attached to the grip members.

14. A hook-on type baby chair for use with a tabletop, comprising:

(a) a chair having a seat portion and a back portion;

(b) a pair of anchor members each secured to the baby chair and dimensioned so that the anchor member extremities overlie the tabletop to position the baby chair for use;

(c) a pair of vertical arm members extending from the anchor members to the seat portion, wherein said vertical arm members are each fixedly attached to said anchor members and fixedly attached to said seat portion;

(d) a pair of grip members each having a gripper foot on one extremity to frictionally contact an undersurface of the tabletop and each of said members pivotably attached to the vertical arm members for movement of the gripper feet towards and away from the anchor member extremities which overlie the tabletop;

(e) latch means associated with the anchor members and the grip members so that when disengaged the grip members are free to pivotably move about their points of attachment and when engaged the gripper foot of each grip member is in fixed contact with the undersurface of the tabletop to securely hold the baby chair to the tabletop, further wherein the latch means are capable of providing a plurality of latch positions to accommodate different thickness tabletops and facilitate removable of the baby chair therefrom; and (f) a spill guard attached to the baby chair, said spill guard made of flexible material and positioned on the baby chair to abut against the tabletop to prevent spills and tableware slide.

15. The hook-on type baby chair of claim 14 wherein the grip members comprise one U-shaped member which extends across the backside of the baby chair with each arm of the U-shaped member representing a grip member.

16. The hook-on type baby chair of claim 14 wherein the vertical arm members comprise one U-shaped member which extends across the underside of the seat bottom with each arm of the U-shaped member representing a vertical arm member.

17. The hook-on type baby chair of claim 14 wherein the latch means comprises at least one ratchet box secured to the anchor member and a pawl secured to the grip member wherein the pawl has a lever such that the lever will engage teeth found on the ratchet box and be held in place, yet when said lever is disengaged from the teeth the grip members freely move about their pivot points.

18. The hook-on type baby chair of claim 17 wherein the seat portion and back portion are one integral piece.

19. The hook-on type baby chair of claim 17 wherein the seat portion and the back portion are two separate pieces dimensioned to mate at their point of contact.

20. The hook-on type baby chair of claim 19 wherein the back portion is pivotably attached to the ratchet box to allow the back portion to fold towards the seat portion about the pivot point.

21. The hook-on type baby chair of claim 14 wherein all the members are tubular shaped.

22. The hook-on type baby chair of claim 14 further comprising a foot rest pivotably attached to the grip members.

23. The hook-on type baby chair of claim 21 further comprising a locking mechanism associated with the ratchet box to add stability to the baby chair.

* * * * *